US010517397B2

(12) United States Patent
Min

(10) Patent No.: US 10,517,397 B2
(45) Date of Patent: Dec. 31, 2019

(54) DRAWER RAIL AND HOME APPLIANCE INCLUDING THE SAME

(71) Applicant: LG Electronics Inc., Seoul (KR)

(72) Inventor: Hyeseong Min, Seoul (KR)

(73) Assignee: LG Electronics Inc., Seoul (KR)

( * ) Notice: Subject to any disclaimer, the term of this patent is extended or adjusted under 35 U.S.C. 154(b) by 24 days.

(21) Appl. No.: 15/862,878

(22) Filed: Jan. 5, 2018

(65) Prior Publication Data

US 2018/0184807 A1 Jul. 5, 2018

(30) Foreign Application Priority Data

Jan. 5, 2017 (KR) ..... 10-2017-0002098

(51) Int. Cl.
*A47B 88/57* (2017.01)
*A47L 15/50* (2006.01)
(Continued)

(52) U.S. Cl.
CPC ..... *A47B 88/57* (2017.01); *A47B 88/477* (2017.01); *A47B 88/493* (2017.01); *A47L 15/507* (2013.01); *A47B 88/437* (2017.01); *A47B 2088/401* (2017.01); *A47B 2088/4278* (2017.01); *A47B 2210/0032* (2013.01); *A47B 2210/17* (2013.01)

(58) Field of Classification Search
CPC ..... A47B 88/57; A47B 88/493; A47B 88/437; A47B 2088/4278; A47B 2088/401; A47B 2210/17; A47B 2210/0032; A47L 15/507
See application file for complete search history.

(56) References Cited

U.S. PATENT DOCUMENTS 3,588,198 A * 6/1971 Stewart ..... A47B 88/43 312/334.11
3,771,849 A * 11/1973 Barber ..... A47B 88/43 312/350
(Continued)

FOREIGN PATENT DOCUMENTS

DE 102013211560 A1 * 12/2014
EP 1552781 A2 7/2005
(Continued)

OTHER PUBLICATIONS

Extended European Search Report in European Application No. 18150334.3, dated Mar. 29, 2018, 9 pages.

*Primary Examiner* — Hanh V Tran
(74) *Attorney, Agent, or Firm* — Fish & Richardson P.C.

(57) ABSTRACT

A drawer rail and a home appliance including the same are disclosed. The home appliance includes a drawer rail configured to withdraw an item accommodation unit provided in a storage chamber. The drawer rail includes a first rail mounted to the storage chamber, a second rail coupled to the item accommodation unit, a third rail disposed between the first rail and the second rail, a first retainer disposed between the first rail and the third rail to allow relative sliding movement, a second retainer disposed between the second rail and the third rail to allow relative sliding movement, a first stopper for limiting an allowable relative sliding distance between the first rail and the third rail, and a second stopper for limiting an allowable relative sliding distance between the second rail and the third rail.

17 Claims, 8 Drawing Sheets

(51) Int. Cl.

| | |
|---|---|
| ***A47B 88/493*** | (2017.01) |
| ***A47B 88/477*** | (2017.01) |
| *A47B 88/437* | (2017.01) |
| *A47B 88/427* | (2017.01) |
| *A47B 88/40* | (2017.01) |

(56) References Cited

U.S. PATENT DOCUMENTS

| | | | | |
|---|---|---|---|---|
| 5,980,007 | A * | 11/1999 | Singh | A47B 88/427 248/222.11 |
| 6,938,617 | B2 * | 9/2005 | Le | F24C 15/16 126/273 R |
| 7,216,646 | B2 * | 5/2007 | Le | F24C 15/16 126/273 R |
| 9,596,931 | B1 * | 3/2017 | Nimgulkar | A47B 88/49 |
| 10,159,344 | B2 * | 12/2018 | Mason | A47B 88/467 |
| 10,228,185 | B2 * | 3/2019 | Cizik | F25D 11/00 |
| 2001/0044992 | A1 * | 11/2001 | Jahrling | A47B 55/02 24/563 |
| 2005/0150523 | A1 * | 7/2005 | Schock | A47L 15/507 134/25.2 |
| 2005/0231083 | A1 * | 10/2005 | Garcie, Jr. | A47B 88/467 312/333 |
| 2006/0250058 | A1 * | 11/2006 | Stevens | A47L 15/502 312/311 |
| 2008/0054772 | A1 * | 3/2008 | Koloff | F25D 25/024 312/404 |
| 2009/0050186 | A1 * | 2/2009 | Kim | A47L 15/504 134/165 |
| 2009/0074334 | A1 | 3/2009 | Juan | |
| 2009/0079312 | A1 * | 3/2009 | Laible | F25D 25/025 312/334.27 |
| 2009/0289537 | A1 * | 11/2009 | Cabal Velarde | A47B 88/956 312/408 |
| 2010/0108109 | A1 * | 5/2010 | Schock | A47L 15/507 134/137 |
| 2013/0152983 | A1 * | 6/2013 | Cox | A47L 15/507 134/164 |
| 2013/0247944 | A1 * | 9/2013 | Fischer | A47L 15/50 134/164 |
| 2014/0145573 | A1 * | 5/2014 | Cox | A47L 15/507 312/228.1 |
| 2014/0145577 | A1 * | 5/2014 | Zimmermann | A47B 88/40 312/327 |
| 2014/0285078 | A1 * | 9/2014 | Armstrong | F24C 15/16 312/312 |
| 2015/0190033 | A1 * | 7/2015 | Shaffer | A47L 15/507 312/228.1 |
| 2015/0190034 | A1 * | 7/2015 | Jeong | A47L 15/507 312/228.1 |
| 2016/0270532 | A1 * | 9/2016 | Gleixner | A47L 15/507 |
| 2016/0331204 | A1 * | 11/2016 | Kutto | A47L 15/504 |
| 2017/0332879 | A1 * | 11/2017 | Gerstner | A47L 15/503 |

FOREIGN PATENT DOCUMENTS

| | | | |
|---|---|---|---|
| EP | 2891447 | A2 | 7/2015 |
| WO | WO2012022788 | A2 | 2/2012 |
| WO | WO2014200125 | A2 | 12/2014 |
| WO | WO2015067596 | A2 | 5/2015 |

* cited by examiner

DRAWER RAIL AND HOME APPLIANCE INCLUDING THE SAME

This application claims the benefit of Korean Patent Application No. 10-2017-0002098, filed on Jan. 5, 2017, which is hereby incorporated by reference as if fully set forth herein.

BACKGROUND OF THE INVENTION

Field of the Invention

The present invention relates to a drawer rail and a home appliance including the same.

Discussion of the Related Art

Generally, a home appliance, such as a refrigerator, a dishwasher, etc., includes a drawer, a shelf or a basket in order to accommodate items therein. Such an item accommodation unit is provided so as to be movable forwards and backwards. For example, the item accommodation unit of a dishwasher is a basket. A user may draw out the basket by pulling the same to put or take dishes in or out of the basket. Thereafter, the user may push the basket into the dishwasher.

The movement of an item accommodation unit in the forward-and-backward direction may be realized by various structures. For example, a rail groove may be formed in a cabinet, and a roller, which is configured to move forwards and backwards along the rail groove, may be mounted to the item accommodation unit. Accordingly, the item accommodation unit is capable of moving forwards and backwards along the rail groove. However, this structure has a shortcoming in that the distance that the item accommodation unit can move forwards and backwards is relatively short and in that, when the weight of the item accommodation unit increases, the movement of the item accommodation unit may not be realized smoothly and stably.

In particular, in the case of a basket of a dishwasher, very heavy dishes are accommodated in the basket. Therefore, in order to stably move the basket forwards and backwards, a very firm support structure is needed for the basket. Further, in order to minimize the movement path of a user when the user puts heavy dishes in the basket or removes the same, the basket needs to be drawn as far as possible out of the main body, the cabinet or the tub of the dishwasher. In particular, dishes accommodated in the basket need to be arranged at a regular interval. The reason for this is to effectively and evenly wash the entire area of the dishes. In the case in which the basket is disposed in the tub, it is more difficult to arrange the dishes in the basket. For this reason, it is desirable to draw the entire basket out of the tub of the dishwasher.

Therefore, a very firm support structure is required in consideration of a relatively long movement distance, a relatively distant withdrawal position, and a relatively heavy weight of the basket and the dishes accommodated therein.

U.S. Patent Publication No. US2010/0108109A1 (hereinafter, referred to as a "prior art") discloses a drawer rail of a dishwasher.

The disclosed drawer rail includes an outer rail (a first rail), which is mounted to a tub, and an outer rail (a second rail), to which a basket is mounted. An inner rail (a third rail) is provided between the above outer rails. The inner rail slides relative to the outer rails using ball bearings, which are provided in a retainer.

When the basket is withdrawn, the second rail first slides relative to the third rail. When the second rail, moving relative to the third rail, reaches the end position, the third rail slides relative to the first rail until it reaches the end position. Therefore, the process of withdrawing the basket is performed in two stages, making it possible to increase the withdrawal distance of the basket and to securely support the weight of the basket.

The first rail, the second rail, and the third rail are coupled to one another from the left to the right in such a way as to be spaced apart from one another. In order to allow the relative movement among the first rail, the second rail, and the third rail, these rails are designed to have sufficient gaps therebetween.

For this reason, as the number of times that the basket is pushed in and drawn out increases or when a very large amount of force is applied to withdraw the basket, the possibility of the rails becoming separated from one another may also increase. This is because the gap between the rails may increase when the second rail moves to the end position from the third rail or when the third rail moves to the end position from the first rail. That is, when the length from a stopper for limiting the maximum movement of each rail to the distal end of each rail increases, the gap between the rails in the lateral direction may increase beyond an allowable range.

Further, the basket is mounted to the second rail and is separated from the second rail as needed. However, it is not easy to mount or separate the basket to or from the second rail because the position of the second rail is not fixed.

Furthermore, the drawer rail is mounted to the tub and is separated from the tub as needed. However, it is not easy to mount or separate the drawer rail to or from the tub because the drawer rail is mounted inside the tub.

SUMMARY OF THE INVENTION

Accordingly, the present invention is directed to a drawer rail and a home appliance including the same that substantially obviate one or more problems due to limitations and disadvantages of the related art.

An object of the present invention is to provide a drawer rail, which has improved reliability by preventing the separation of sub-rails constituting the drawer rail, and a home appliance including the same.

Another object of the present invention is to provide a drawer rail, which is capable of being easily engaged with or disengaged from an item accommodation unit, and a home appliance including the same.

A further object of the present invention is to provide a drawer rail, which is capable of being easily engaged with or disengaged from a home appliance, and a home appliance including the same.

A further object of the present invention is to provide a drawer rail, which is capable of being more securely fixed to a home appliance, and a home appliance including the same.

A further object of the present invention is to provide a drawer rail, which is capable of preventing noise from occurring between the drawer rail and a home appliance, and a home appliance including the same. In particular, the present invention provides a drawer rail and a home appliance that is capable of preventing noise from occurring between a bracket mounted to the home appliance and the drawer rail.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a home appliance includes a drawer rail configured to withdraw an item accommodation unit provided in a storage chamber, and the drawer rail includes a first rail mounted to the storage chamber, a second rail coupled to the item accommodation unit, a third rail disposed between the first rail and the second rail, a first retainer disposed between the first rail and the third rail to allow relative sliding movement, a second retainer disposed between the second rail and the third rail to allow relative sliding movement, a first stopper for limiting an allowable relative sliding distance between the first rail and the third rail, the first stopper being disposed at a position further inward than a distal end of the first rail and a distal end of the first retainer, and a second stopper for limiting an allowable relative sliding distance between the second rail and the third rail, the second stopper being disposed at a position further inward than a distal end of the second rail and a distal end of the second retainer.

The home appliance may be a dishwasher.

The first rail and the second rail may include vertical surfaces and bent surfaces bent laterally from upper ends and lower ends of the vertical surfaces.

The first rail and the second rail may be formed of stainless steel.

The vertical surfaces may have therein a plurality of perforated portions, and the first rail and the second rail may be formed so as to have the same size, the same shape and the same perforated portions as each other.

The perforated portions may include bending-perforated portions for a bending process, and the first stopper and the second stopper may include stopper flanges formed by bending portions of the vertical surfaces through the bending-perforated portions formed in the first rail and the second rail.

Each of the first rail and the second rail may have two bending-perforated portions formed in each of a left portion and a right portion thereof.

The stopper flanges of the first stopper may be formed through a first bending-perforated portion from the left and a second bending-perforated portion from the right in the first rail, and the stopper flanges of the second stopper may be formed through a second bending-perforated portion from the left and a first bending-perforated portion from the right in the second rail.

The positions of the stopper flanges of the first stopper and the positions of the stopper flanges of the second stopper may be inversely symmetrical to each other.

The first stopper and the second stopper may include stopper protrusions formed at the first retainer and the second retainer.

The first retainer and the second retainer may include ball accommodation portions formed at upper ends and lower ends of the first retainer and the second retainer to accommodate balls therein, and connecting portions for connecting the ball accommodation portions formed at the upper ends and the ball accommodation portions formed at the lower ends to each other.

The connecting portions may include end-connecting ribs formed at left ends and right ends of the first retainer and the second retainer, and middle-connecting ribs formed between the end-connecting ribs.

The stopper protrusions may be formed at the middle-connecting ribs.

The direction in which the stopper flanges and the stopper protrusions collide with each other may be the same as the direction in which the stopper flanges are bent.

The bending-perforated portions may be located at positions further inward than the outermost perforated portions.

The perforated portions may include bracket-perforated portions for mounting the drawer rail to a home appliance, and a front-holder-perforated portion and a rear-holder-perforated portion for mounting the item accommodation unit to the drawer rail.

The drawer rail may further include a front holder coupled to the front-holder-perforated portion, the front holder including an insertion portion extending from an upper end thereof in a downward direction, and a rear holder coupled to the rear-holder-perforated portion, the rear holder including an insertion portion extending from a rear end thereof in a forward direction.

The drawer rail may further include retainer stoppers provided at the third rail to limit movement ranges of the first retainer and the second retainer.

The third rail may be formed to be horizontally symmetrical, and the first retainer may be accommodated in one side of the third rail and the second retainer may be accommodated in the opposite side of the third rail.

The retainer stoppers may include a front retainer stopper and a rear retainer stopper, the front retainer stopper and the rear retainer stopper being configured to contact one end and the opposite end of the first retainer, respectively.

The retainer stoppers may include a front retainer stopper and a rear retainer stopper, the front retainer stopper and the rear retainer stopper being configured to contact one end and the opposite end of the second retainer, respectively.

The retainer stoppers may be configured to contact upper ends and lower ends of the first retainer and the second retainer.

The first stopper and the second stopper may include stopper flanges formed at the first rail and the second rail, and the stopper flanges may be formed at middle portions between upper ends and lower ends of the first rail and the second rail in order to avoid interference with the retainer stoppers.

In another aspect of the present invention, a home appliance includes a drawer rail configured to withdraw an item accommodation unit provided in a storage chamber, and the drawer rail includes a first rail mounted to the storage chamber, a second rail coupled to the item accommodation unit, a third rail disposed between the first rail and the second rail, a first retainer disposed between the first rail and the third rail to allow relative sliding movement, a second retainer disposed between the second rail and the third rail to allow relative sliding movement, a first stopper (point A) for restricting movement between the first rail and the first retainer at a position behind a front end of the first rail when the third rail is maximally extended from the first rail, and a second stopper (point A) for restricting movement between the second rail and the second retainer at a position in front of a rear end of the second rail when the second rail is maximally extended from the third rail.

The first rail and the second rail may have therein a plurality of perforated portions formed in a longitudinal direction thereof. The first stopper and the second stopper may be formed through perforated portions, which are formed at positions further inward than perforated portions formed at left and right ends of the first and second rails.

In a further aspect of the present invention, a home appliance includes a drawer rail configured to withdraw an item accommodation unit provided in a storage chamber and a rail bracket configured to mount the drawer rail to the storage chamber, the rail bracket includes a body configured to be mounted to the storage chamber, and bracket hooks provided at openings formed in a front portion and a rear portion of the body, and the drawer rail includes rail holes into which the bracket hooks are respectively inserted.

The bracket hooks may include latching portions provided at front ends of the openings in order to limit forward movement of the drawer rail, and cover portions extending backwards from the latching portions in order to limit lateral movement of the drawer rail.

The rail holes may be formed such that the latching portions and the cover portions are all inserted into the rail holes.

The bracket hooks may be formed such that, when the drawer rail moves backwards in a state in which the latching portions and the cover portions are inserted into the rail holes, rear ends of the rail holes are caught by the latching portions.

The body may include contact portions configured to closely contact a side wall of the storage chamber, and raised portions formed to protrude relative to the contact portions so as to be spaced apart from the side wall of the storage chamber.

The bracket hooks may be formed at the raised portions.

The raised portions may include hook-perforated portions for forming the bracket hooks, and the bracket hooks may be formed by bending portions of the raised portions.

The raised portions may include stoppers provided behind the bracket hooks in order to limit backward movement of the drawer rail.

The raised portions may include stopper-perforated portions for forming the stoppers, and the stoppers may be formed by bending portions of the raised portions.

The raised portions may include upper portions, lower portions, and connection portions for connecting the upper portions and the lower portions to each other in a vertical direction, and the hook-perforated portions and the stopper-perforated portions may be spaced laterally apart from each other, with the connection portions interposed therebetween.

The raised portions may further include beads formed at the upper portions and the lower portions to reinforce rigidity thereof.

The rail holes may include a rear rail hole having a relatively long length in a forward-and-backward direction and a front rail hole having a relatively short length in a forward-and-backward direction.

When rear ends of the rail holes are caught by the latching portions, a front end of the rear rail hole may be spaced apart from a corresponding one of the stoppers and a front end of the front rail hole may contact a corresponding one of the stoppers.

The front rail hole may be provided at the front end thereof with a stepped portion, and a portion of the front end of the front rail hole may contact a corresponding one of the stoppers and a remaining portion of the front end of the front rail hole may be spaced apart from the corresponding one of the stoppers due to the stepped portion.

The rail holes may include inclined portions formed such that vertical widths thereof gradually decrease from rear ends of the rail holes toward front ends of the rail holes, and straight portions extending from the inclined portions to the front ends of the rail holes and having constant vertical widths.

The contact portions may be disposed in front of and behind the raised portions, and the contact portions may be provided with welded portions in order to be welded to a side wall of the storage chamber.

The drawer rail may include a first rail mounted to the storage chamber, a second rail coupled to the item accommodation unit, a third rail disposed between the first rail and the second rail, a first retainer disposed between the first rail and the third rail to allow relative sliding movement, a second retainer disposed between the second rail and the third rail to allow relative sliding movement, a first stopper for limiting an allowable relative sliding distance between the first rail and the third rail, and a second stopper for limiting an allowable relative sliding distance between the second rail and the third rail.

The first rail and the second rail may include vertical surfaces and bent surfaces bent laterally from upper ends and lower ends of the vertical surfaces, the vertical surfaces may have therein a plurality of perforated portions, and the first rail and the second rail may be formed so as to have the same size, the same shape and the same perforated portions as each other.

The perforated portions may include the rail holes.

The perforated portions may include a front-holder-coupling portion and a rear-holder-coupling portion for mounting the item accommodation unit to the drawer rail.

The drawer rail may further include a front holder coupled to the front-holder-coupling portion, the front holder including an insertion portion extending from an upper end thereof in a downward direction, and a rear holder coupled to the rear-holder-coupling portion, the rear holder including an insertion portion extending from a rear end thereof in a forward direction.

The features of the above embodiments may be applied in combination with those of other embodiments unless the features are contradictory or exclusive.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a drawer rail will be described in brief with reference to FIG. 1. For convenience of explanation, a home appliance to which the drawer rail according to the embodiment is mounted will be described as being a dishwasher by way of example. However, the disclosure is not limited thereto.

The drawer rail 100 may include a first rail 200, a second rail 300, and a third rail 400.

The first rail 200 may be a fixed rail, which is fixed to a side wall of a storage chamber, for example, a side wall of a tub of the dishwasher. The second rail 300 may be a movable rail, which is coupled to an item accommodation unit, for example, a basket of the dishwasher. That is, the first rail 200 is fixed with respect to the storage chamber, and the second rail 300 is movable with respect to the storage chamber.

The third rail 400 is provided between the first rail 200 and the second rail 300. The third rail 400 is provided so as to be slidable with respect to the first rail 200 and the second rail 300.

Figure 1:
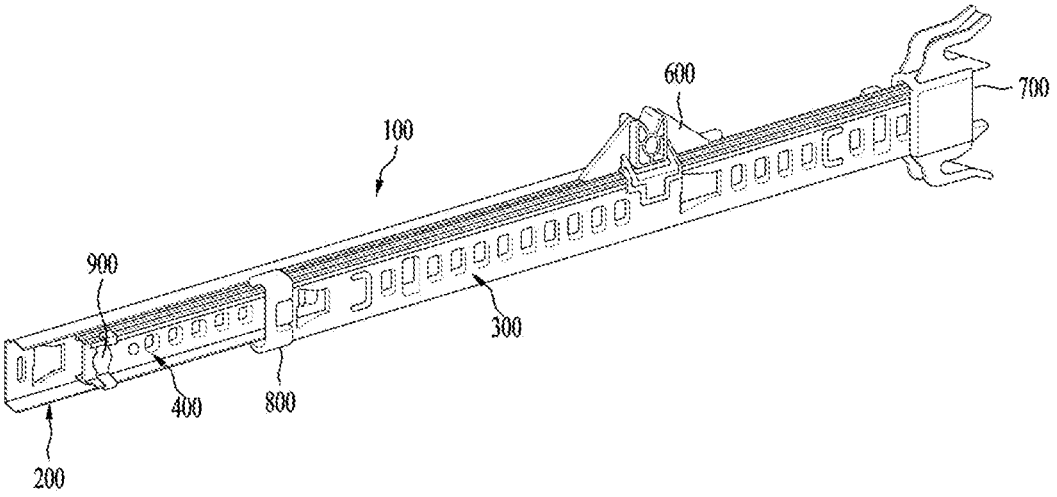
FIG. 1 illustrates the appearance of a drawer rail according to an embodiment of the present invention, which is applicable to a home appliance.

FIG. 1 shows the state in which the basket is maximally introduced into the tub. In FIG. 1, the left side denotes a front side of the tub, and the right side denotes a rear side of the tub.

The second rail 300 is provided with a holder, to which a basket 10 (refer to FIG. 10) is coupled. The holder may include a front holder 600 and a rear holder 700 in order to stably support the basket. The holder is mounted to the second rail 300, and the basket is mounted to the holder. Therefore, when the second rail 300 moves, the basket also moves together therewith.

The drawer rail shown in FIG. 1 may be a left drawer rail. Each of the left drawer rail and the right drawer rail is provided at a corresponding one of the left side and the right side of the basket so as to stably support the basket and allow the basket to move forwards and backwards. It is desirable for the left drawer rail and the right drawer rail to be formed so as to be symmetrical with each other.

The rear holder 700 may be provided at the rear end of the second rail 300. The rear holder 700 serves to prevent the rear end of the second rail 300 from being exposed outside.

The second rail 300 is provided at the front end thereof with a cap 800. When the drawer rail is maximally extended, the front end of the second rail 300 is located at the foremost position. Therefore, it is necessary to prevent exposure of the front end of the second rail 300, because it is very sharp. The cap 800 may prevent direct exposure of the front end of the second rail 300, thereby ensuring safety.

Figure 4:
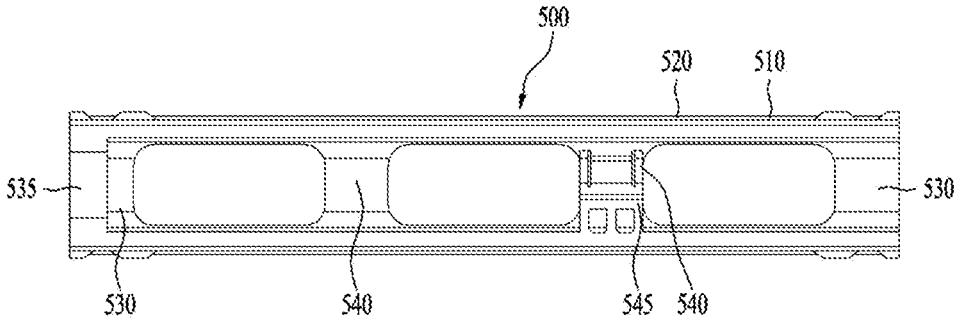
FIGS. 4 and 5 illustrate a retainer of the drawer rail shown in FIG. 1.

The drawer rail 100 further includes a retainer 500 (refer to FIG. 4). The retainer 500 serves to facilitate sliding movement between the first rail 200 and the third rail 400. The retainer 500 also serves to facilitate sliding movement between the second rail 300 and the third rail 400.

The retainer 500 includes a left retainer **500*a* (refer to FIG. 6) and a right retainer 500*b*. The left retainer 500*a* is accommodated in a left third rail 400*a* (refer to FIG. 6), and the right retainer 500*b* is accommodated in a right third rail 400*b*. Specifically, the left retainer 500*a* is disposed between the first rail 200 and the left third rail 400*a*, and the right retainer 500*b* is disposed between the second rail 300 and the right third rail 400*b*. The third rail 400** forms a unitary rail body through the engagement of the left retainer and the right retainer, which are formed symmetrically with each other.

Hereinafter, the configuration of the respective components that constitute the drawer rail 100 will be described in detail.

The first rail 200 and the second rail 300 will now be described with reference to FIGS. 2 and 3.

Each of the left drawer rail and the right drawer rail, which constitute the drawer rail 100, is provided at a corresponding one of the left side and the right side of the basket. Therefore, if the components constituting the left drawer rail and the components constituting the right drawer rail are different from each other, the number of parts that are manufactured and maintained increases, and accordingly, manufacturing costs increase.

It is desirable for the first rail 200 and the second rail 300 to have the same shape and the same size as each other. The reason for this is to reduce the processes of manufacturing and maintaining the components and consequently to reduce manufacturing costs.

The first rail 200 and the second rail 300 may have a plurality of perforated portions 211 and 311 formed therein. The respective perforated portions have specific functions and purposes in accordance with the shapes and the locations thereof.

The first rail 200 and the second rail 300 may be formed of stainless steel in order to ensure rigidity and durability. The first rail 200 and the second rail 300 may include vertical surfaces 210 and 310 and bent surfaces 220 and 320, which are bent laterally from the upper ends and the lower ends of the vertical surfaces. The bent surfaces may be oriented toward the third rail 400.

In other words, the first rail 200 and the second rail 300 are manufactured in a manner such that the bent surfaces are formed by bending the upper ends and the lower ends of the long plates and such that the perforated portions are formed in the vertical surfaces.

As described above, it is desirable for the first rail 200 and the second rail 300 to have the same size and the same shape as each other. In addition, it is desirable for the perforated portions formed in the first rail 200 and the perforated portions formed in the second rail 300 to have the same position and the same shape as each other. That is, it is desirable for the first rail 200 and the second rail 300 to be the same as each other when the perforated portions are completely formed. However, the first rail 200 and the second rail 300 differ from each other with respect to the positions of the stopper flanges 216 and 316.

The perforated portions may include bending-perforated portions 213 for forming the stopper flanges. The bending-perforated portions 213 may be perforated portions having a channel shape. The stopper flanges 216 and 316 may be formed by bending the portions of the vertical surfaces 210 and 310 in which the perforated portions are not formed. The stopper flanges constitute a first stopper and a second stopper, which will be described later.

The stopper flanges are bent substantially perpendicular to the vertical surfaces 210 and 310 and extend toward the third rail 400.

Figure 2:
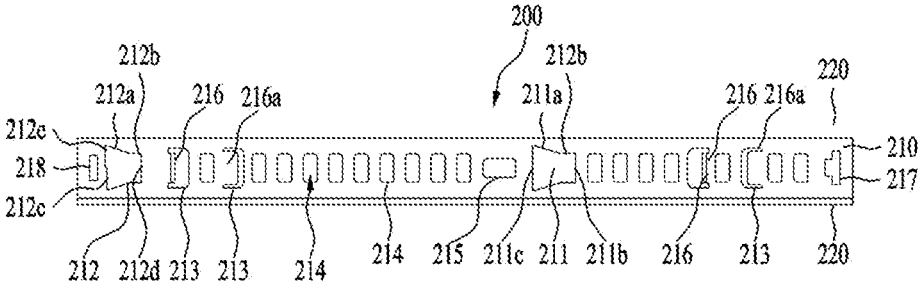
FIG. 2 illustrates a first rail of the drawer rail shown in FIG. 1.
Figure 3:
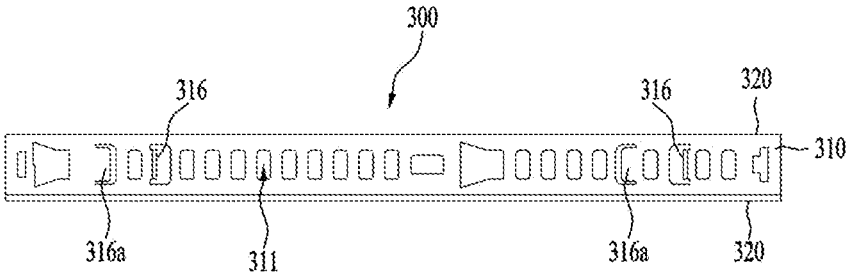
FIG. 3 illustrates a second rail of the drawer rail shown in FIG. 1.

As shown in FIGS. 2 and 3, each of the first rail 200 and the second rail 300 may have two bending-perforated portions 213 formed in each of the left portion and the right portion thereof. In the first rail 200, the stopper flanges may be formed at the first bending-perforated portion from the left and the second bending-perforated portion from the right. Vertical surfaces 216*a*, which are formed at the remaining bending-perforated portions, may not be bent. In the second rail 300, the stopper flanges may be formed at the second bending-perforated portion from the left and the first bending-perforated portion from the right. Vertical surfaces 316*a*, which are formed at the remaining bending-perforated portions, may not be bent. Therefore, the positions of the stopper flanges in the first rail and the positions of the stopper flanges in the second rail may have an inversely symmetrical relationship therebetween.

The bending process for forming the stopper flanges at the first rail 200 and the bending process for forming the stopper flanges at the second rail 300 may be performed at the same time. That is, the stopper flanges may be formed in a manner such that the first rail 200 is introduced into a bending mold in the forward direction and the second rail 300 is introduced into the same bending mold in the backward direction. The forward direction and the backward direction may be easily distinguished from each other by jigs for fixing the first rail and the second rail to the bending mold. Therefore, it is very convenient to manufacture and maintain the first rail 200 and the second rail 300.

In addition to the aforementioned bending-perforated portions, the perforated portions 211 and 311 may further include holder-perforated portions 215 and 217 and cap-perforated portions 218. The perforated portions 211 and 311 may further include bracket-perforated portions 211 and 212. The perforated portions 211 and 311 may further include washing-perforated portions 214 for preventing foreign substances from adhering to the rails. The washing-perforated portions may be provided in a plural number and may use wash water flowing thereinto to remove foreign substances.

As described above, the holders 600 and 700 and the cap 800 are coupled to the first rail 200. Therefore, the holders and the cap are fixedly inserted into the holder-perforated portions 215 and 217 and the cap-perforated portion 218, which are formed in the first rail. However, these perforated portions are also formed in the second rail. The holder-perforated portions and the cap perforated portion, which are formed in the second rail, are not associated with the coupling of the holders and the cap to the rail, but are dummy perforated portions, which are formed for convenience of manufacturing processes.

The first rail 200 is mounted to the tub via rail brackets. To this end, the bracket-perforated portions 211 and 212 are formed in the first rail 200. However, these perforated portions are also formed in the second rail. The bracket-perforated portions, which are formed in the second rail, are not associated with the coupling of the rail to the rail brackets, but are dummy perforated portions, which are formed for convenience of manufacturing processes.

However, these dummy perforated portions function as the washing-perforated portions so that wash water can smoothly flow into the drawer rail in the longitudinal direction of the first rail and the second rail. Therefore, it is possible to easily clean the drawer rail and to prevent foreign substances from being accumulated on the drawer rail.

Figure 5:
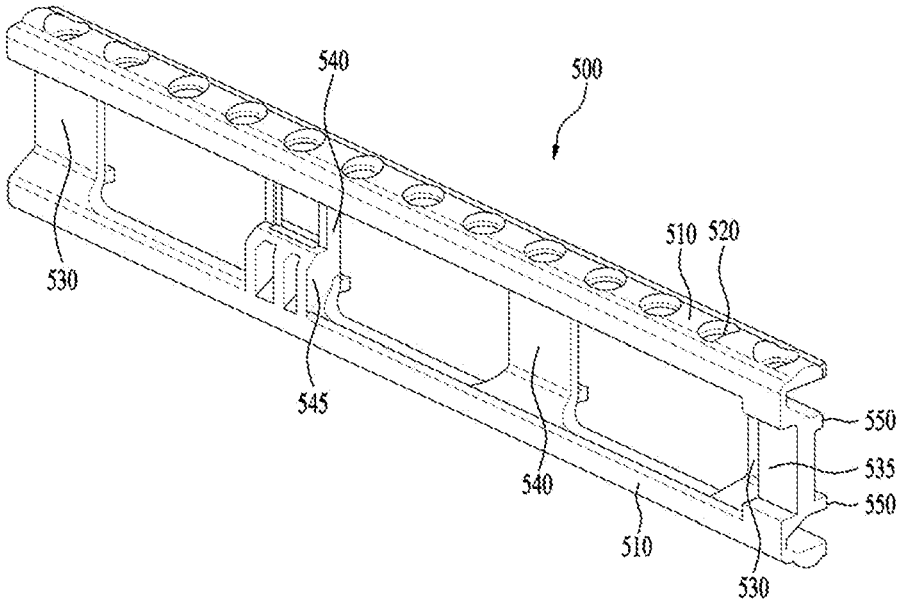

Hereinafter, the retainer will be described in detail with reference to FIGS. 4 and 5.

The retainer may be a housing for accommodating balls. That is, the retainer may be configured such that ball bearings are mounted in the longitudinal direction so that the drawer rail, to which a load is applied in the downward direction, can slide forwards and backwards.

To this end, ball accommodation portions 510 are formed at the retainer 500, and a plurality of ball accommodation holes 520 is formed in the ball accommodation portions 510 in the longitudinal direction of the retainer 500. The ball accommodation portions 510 are disposed at the upper end and the lower end of the retainer 500. The retainer 500 further includes connecting portions 530 and 540 for connecting the upper ball accommodation portion and the lower ball accommodation portion to each other.

The ball accommodation holes 520, in which the balls are accommodated, communicate with the regions above and below the holes. Therefore, the upper regions of the balls contact the bent surface of the first rail or the second rail, and the lower regions of the balls contact the bent surface of the third rail. Therefore, the first rail or the second rail may be slidably supported by the balls provided in the retainer 500.

The connecting portions 530 and 540 may be formed in a rib shape. The connecting portions 530 and 540 may include end-connecting ribs 530, which are formed at the left side and the right side of the retainer 500, and middle-connecting ribs 540, which are formed between the end-connecting ribs 530. Four connecting portions are illustrated in FIGS. 4 and 5. Among the four connecting portions, the number of middle-connecting ribs 540 is two. It is desirable for the connecting portions to be arranged at regular intervals.

Any one of the middle-connecting ribs 540 may be provided with a stopper protrusion 545. The stopper protrusion 545 may constitute the first stopper, which serves to limit the allowable relative sliding distance between the first rail and the third rail. The stopper protrusion 545 may also constitute the second stopper, which serves to limit the allowable relative sliding distance between the second rail and the third rail.

The stopper protrusion 545 is configured to contact the aforementioned stopper flanges 216. When the stopper protrusion 545 and the stopper flanges 216 come into contact with each other, relative sliding movement between the first rail and the third rail is no longer possible. At this time, the combination of the stopper protrusion 545 and the stopper flanges 216 may be referred to as the first stopper.

In the same manner, when the stopper protrusion 545 and the stopper flanges 316 come into contact with each other, relative sliding movement between the second rail and the third rail is no longer possible. At this time, the combination of the stopper protrusion 545 and the stopper flanges 316 may be referred to as the second stopper.

The retainer 500 does not escape from the first rail. In the same manner, the retainer 500 does not escape from the third rail. In order to maximize the movable distance of the first rail with respect to the third rail, the retainer 500 is allowed to move from one end of the first rail to the opposite end of the first rail. Further, the retainer 500 needs to be prevented from escaping from the one end or the opposite end of the first rail. To this end, the first stopper is required. That is, the first stopper prevents the retainer 500 from escaping from the first rail and consequently prevents the first rail from moving further with respect to the third rail. In the same manner, the second stopper prevents the retainer 500 from escaping from the second rail and consequently prevents the second rail from moving further with respect to the third rail.

The position of the first stopper is very important. The stopper protrusion 545 is not formed at each end of the retainer 500 but is formed at the middle-connecting rib 540, whereby the stopper protrusion 545 may be moved in the inward direction of the retainer. Due to the position of the stopper protrusion 545 and the positions of the stopper flanges that correspond to the position of the stopper protrusion 545, it is possible to effectively prevent the first rail from being separated from the third rail. In addition, it is possible to effectively prevent the second rail from being separated from the third rail. A description thereof will be made later.

Figure 6:
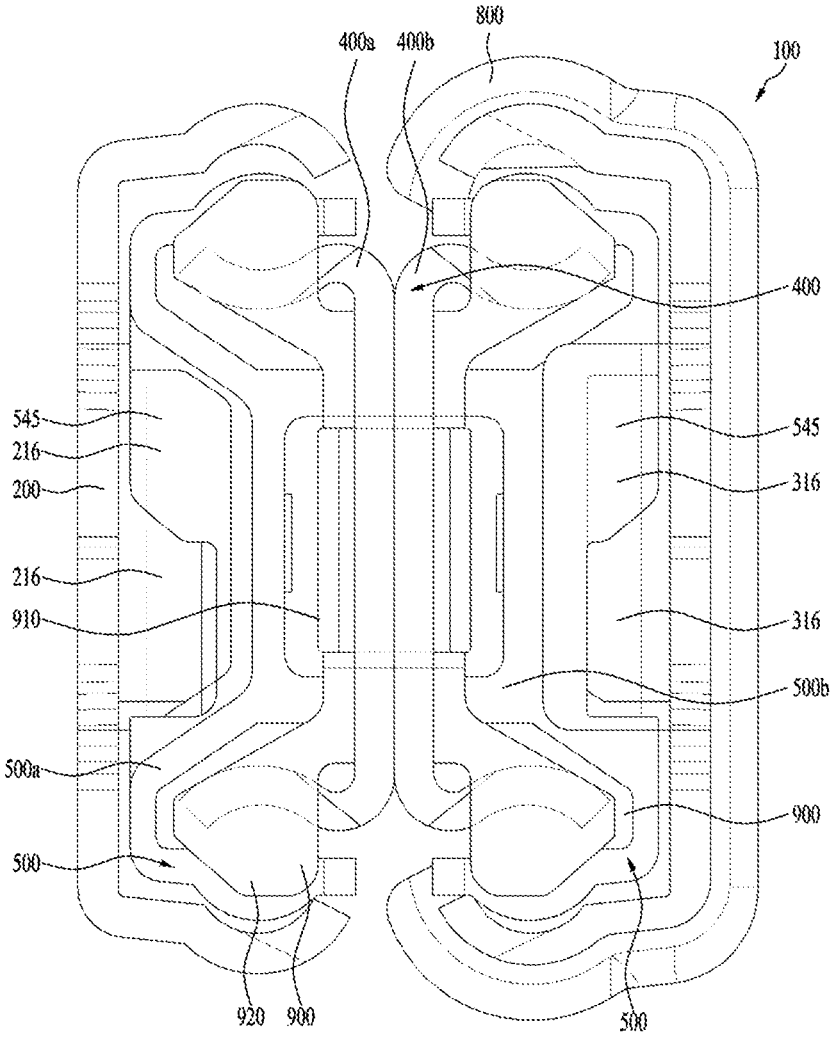
FIG. 6 illustrates the cross-section of the drawer rail shown in FIG. 1.

FIG. 6 illustrates the cross-section of the drawer rail 100.

As shown in FIG. 6, the third rail 400 includes the left rail 400*a* and the right rail 400*b*, which are formed symmetrically to each other. The left rail 400*a* is slidably coupled to the first rail 200 through the left retainer 500*a*, and the right rail 400*b* is slidably coupled to the second rail 300 through the right retainer 500*b*.

The movement of the first rail 200 is limited by contact between the stopper flanges 216 thereof and the stopper protrusion 545 of the left retainer 500*a*. The movement of the second rail 300 is limited by contact between the stopper flanges 316 thereof and the stopper protrusion 545 of the right retainer 500*b*.

The first stopper or the second stopper, which includes the stopper protrusion and the stopper flanges, is formed at the middle of the retainer in the vertical direction. Therefore, the stopper flanges are capable of freely passing by the end-connecting ribs of the retainer and are also capable of freely passing by the middle-connecting rib having no stopper protrusion.

The third rail 400 is provided with stoppers 900 for limiting the movement distance of the retainer 500 in the forward-and-backward direction. The left rail 400*a* may be provided with two stoppers 900, and the right rail 400*b* may be provided with two stoppers 900. Therefore, the retainer 500 may move only between two stoppers 900. When the retainer 500 contacts the stoppers 900, further movement of the retainer 500 is prevented.

The stoppers 900 are provided so as to contact the upper portion and the lower portion of the retainer 500. That is, the front ends and the rear ends of the upper and lower ball accommodation portions contact the stoppers 900. Therefore, contact between the stopper flanges 316 and the stoppers 900 is prevented.

Each of the stoppers 900 includes a coupling portion 910 and a latching portion 920. The coupling portion 910, which is formed at the middle of the stopper 900 in the vertical direction, is fixedly inserted into the perforated portion of the third rail. The latching portion 920 extends from the coupling portion 910 and contacts the front end or the rear end of the retainer 500.

Figure 7:
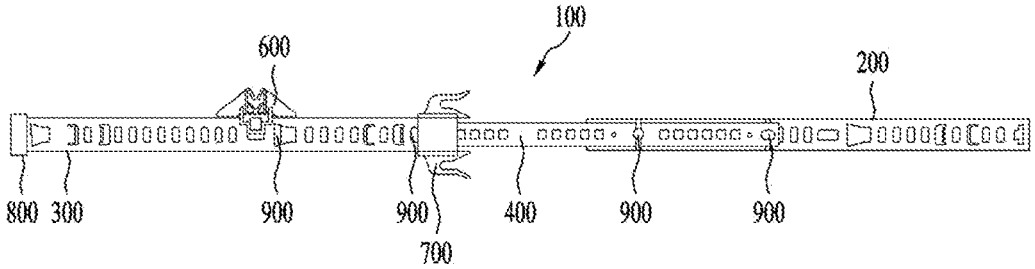
FIG. 7 illustrates the state in which the drawer rail is maximally extended.

FIG. 7 illustrates the state in which the drawer rail is maximally extended. In FIG. 7, the right side denotes a rear side of the tub, and the left side denotes a front side of the tub. The third rail 400 is in the state of being maximally extended from the first rail 200, and the second rail 300 is in the state of being maximally extended from the third rail 400.

Hereinafter, the position of the retainer when the drawer rail is in the state of being maximally contracted and in the state of being maximally extended will be described with reference to FIGS. 8 and 9. In the drawings, the right side denotes a front side of the tub, and the left side denotes a rear side of the tub.

When the drawer rail is maximally contracted, the front end of the left retainer 500*a* contacts the stopper 800*a*, and the stopper protrusion of the left retainer 500*a* contacts the stopper flanges of the first rail. Therefore, the backward movement of the left retainer 500*a* and the third rail 400 is prevented.

In the same manner, when the drawer rail 100 is maximally contracted, the rear end of the right retainer 500*b* contacts the stopper 800*b*, and the stopper protrusion of the right retainer 500*b* contacts the stopper flanges of the second rail 300. Therefore, the backward movement of the right retainer 500*b* and the second rail 300 is prevented.

Figure 8:
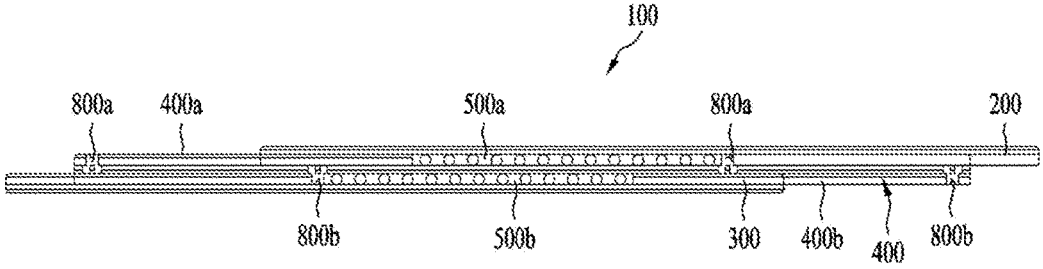
FIG. 8 illustrates the position of the retainer when the drawer rail is maximally contracted.

When the drawer rail is maximally contracted, as shown in FIG. 8, the section in which all of the first rail, the second rail and the third rail overlap one another is very long. Therefore, the amount of engagement force thereamong is very large in the vertical and horizontal directions. As a result, although predetermined gaps are present among the rails, the gaps are prevented from being increased by external force and therefore the rails are prevented from being separated from one another.

Figure 9:
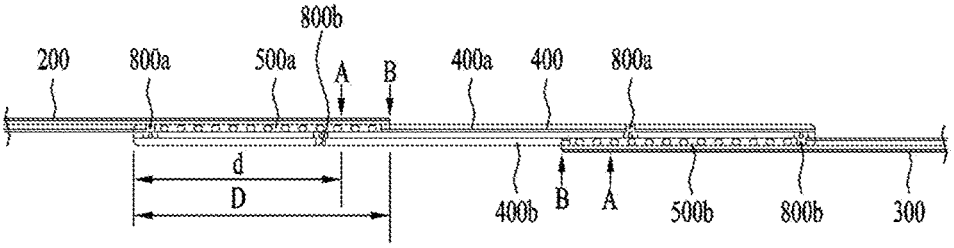
FIG. 9 illustrates the position of the retainer when the drawer rail is maximally extended.

However, as shown in FIG. 9, when the drawer rail is maximally extended, there is no section in which all of the first rail, the second rail and the third rail overlap one another. Only an overlapping section between the first rail and the third rail and an overlapping section between the second rail and the third rail are present. Further, these overlapping sections are very short. Therefore, there may occur a problem in which the sizes of the gaps between the rails are increased by external force and consequently the rails are separated from one another.

In order to prevent this problem, the first stopper may be disposed at a position further inward than the distal end of the first rail 200 and the distal end of the left retainer 500*a*.

In FIG. 9, if the first stopper is positioned at the distal end of the first rail 200 and the distal end (point B) of the left retainer 500*a*, deformation of the rails may occur over a section indicated by the distance D. That is, a section in which the first rail 200 and the third rail 400 are spaced further apart from each other may become very long. This principle is the same as that of a cantilever in which one end is a fixed end and the opposite end is a free end. In other words, under the condition in which the amount of load applied to the cantilever is constant, the longer the cantilever, the larger the displacement of the free end of the cantilever.

If the first stopper is positioned at the position A in FIG. 9, deformation of the rails may occur over a section indicated by the distance d. This means a reduction in the length of a cantilever. That is, it is possible to minimize the displacement by which the first rail 200 and the third rail 400 are spaced further apart from each other.

This principle may also be applied to the second stopper. It is possible to minimize the displacement by which the second rail 300 and the third rail 400 are spaced further apart from each other by adjusting the position of the second stopper.

The adjustment in the positions of the first stopper and the second stopper may be realized as a change in the direction in which the stopper flanges are bent. If the stopper flanges are formed at the distal end of the first rail or the distal end of the second rail, the stopper flanges may be bent inwards of the first rail and the second rail. When the retainer contacts the stopper flanges, the first rail and the second rail are pushed in the outward direction thereof. That is, the direction in which the pushing force is applied is opposite the direction in which the stopper flanges are bent. Therefore, there is a risk that the function of the stopper may be deteriorated due to continuous usage.

However, if the stopper flanges are formed at a position further inward than the distal end of the first rail or the distal end of the second rail, it is possible to bend the stopper flanges in the reverse direction. That is, the stopper flanges may be bent in the outward direction of the first rail and the second rail. Therefore, the direction in which the force is applied through the retainer is the same as the direction in which the stopper flanges are bent. According to the intensity characteristics of the metal bending structure, it is more effective to support force that is applied in the bending direction than to support force that is applied in the direction opposite the bending direction. Therefore, it is possible to effectively maintain the function of the stopper in spite of continuous usage.

Figure 10:
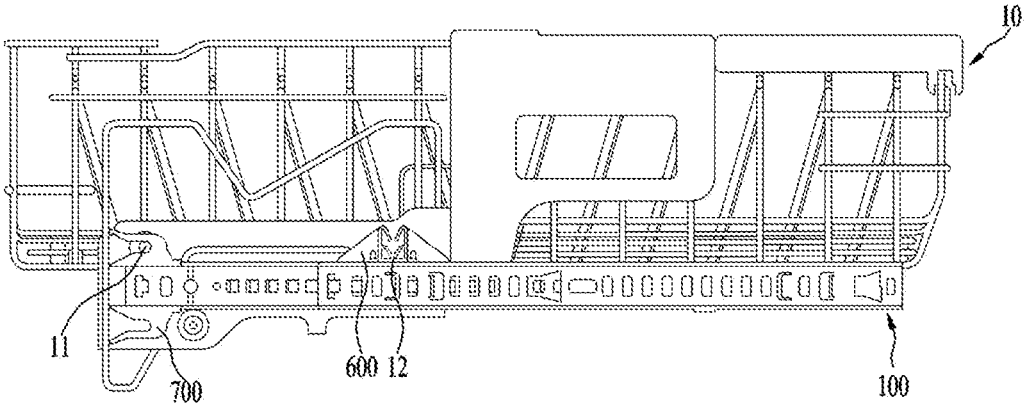
FIG. 10 illustrates the state in which the drawer rail and the basket are coupled to each other.

Hereinafter, the engagement/disengagement structure of the drawer rail 100 and the basket 10 will be described in detail with reference to FIG. 10. FIG. 10 illustrates the state in which the basket 10 is maximally introduced into the tub.

The basket 10 may include at least two support points, which are provided at a portion of the basket 10, for example, the left side or the right side of the basket 10. The two support points may be points at which the basket 10 and the drawer rail 100 are engaged with each other. A portion of the basket 10 may be seated on and supported by the drawer rail 100, specifically, the second rail 300. However, these support points on which the basket is seated support only the load applied in the downward direction, but do not withstand force applied in the forward-and-backward direction or in the upward direction.

The support points may include a support point, which is formed by the rear holder 700 and a first protrusion 11, and a support point, which is formed by the front holder 600 and a second protrusion 12.

The first protrusion 11 and the second protrusion 12 may protrude from the basket 10 in the lateral direction, i.e., toward the drawer rail. The first protrusion 11 may be engaged with the rear holder 700, and the second protrusion 12 may be engaged with the front holder.

The rear holder 700 may be configured to support the basket 10 in the forward-and-backward direction and in the upward-and-downward direction. In order to allow the first protrusion 11 to be inserted into the rear holder 700, the allowable limit on the support of the first protrusion 11 in the insertion direction may be set to be larger than the allowable limit on the support of the first protrusion 11 in the direction opposite the insertion direction. It is desirable for the first protrusion 11 to be inserted into the rear holder 700 from the rear to the front. That is, it is desirable to insert the first protrusion 11 into the rear holder 700 by pulling the basket 10. Accordingly, the basket 10 may be more securely supported in the direction in which the basket 10 is withdrawn by the rear holder 700.

The front holder 600 may be configured to support the basket 10 in the forward-and-backward direction and in the upward-and-downward direction. In order to allow the second protrusion 12 to be inserted into the front holder 600, the allowable limit on the support of the second protrusion 12 in the insertion direction may be set to be larger than the allowable limit on the support of the second protrusion 12 in the direction opposite the insertion direction. It is desirable for the second protrusion 12 to be inserted into the front holder 600 from the top to the bottom. That is, it is desirable to insert the second protrusion 12 into the front holder 600 by lowering the basket 10. Accordingly, the basket 10 may be more securely supported in the forward-and-backward direction by the front holder 600.

Because the direction in which the first protrusion 11 is engaged with the rear holder 700 and the direction in which the second protrusion 12 is engaged with the front holder 600 are different from each other, it is very easy to assemble and disassemble the drawer rail 100 and the basket 10. That is, the first protrusion 11 is engaged with the rear holder 700 by pulling the basket 10 in the state of placing the rear portion of the basket 10 at a relatively low position and the front portion of the basket 10 at a relatively high position. Subsequently, the second protrusion 12 is engaged with the front holder 600 by lowering the front portion of the basket. When the basket 10 is pulled, the drawer rail 100 is maximally withdrawn. Therefore, it is possible to easily assemble the basket 10 with the drawer rail 100 outside the tub. The processes of disassembling the basket 10 from the drawer rail 100 may be performed reversely to the above-described assembly processes.

Figure 11:
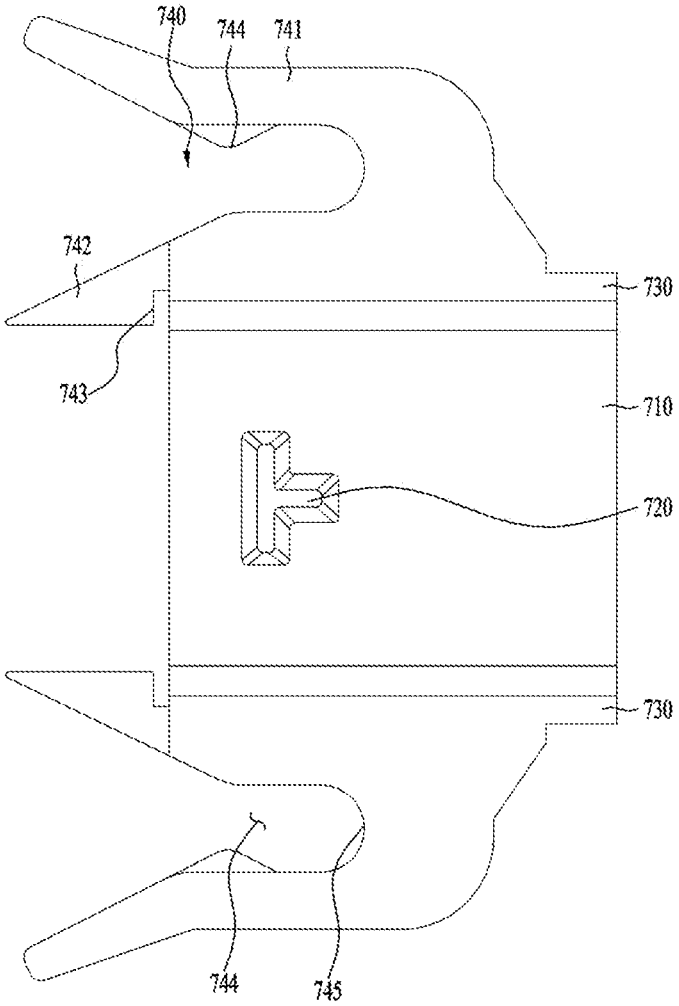
FIG. 11 illustrates the appearance of a rear holder of the drawer rail.

Hereinafter, the configuration of the rear holder 700 will be described in detail with reference to FIG. 11.

The rear holder 700 includes a vertical surface 710 and bent surfaces 730, which are formed at the upper end and the lower end of the vertical surface. The vertical surface 710 is configured to contact the vertical surface of the second rail 300, and the bent surfaces 730 are configured to cover the upper bent surface and the lower bent surface of the second rail 300. Because the rear holder 700 is coupled to the rear end of the second rail 300, the rear holder 700 needs to be prevented from being separated backwards from the rear end of the second rail 300 or from being moved forwards from the rear end of the second rail 300.

To this end, the vertical surface 710 may be provided with a protrusion 720. The protrusion 720 is inserted into the rear-holder-perforated portion 217 formed in the second rail 300.

The rear holder 700 includes an insertion portion 740, into which the first protrusion 11 is inserted. The insertion portion 740 may be formed such that the vertical width thereof gradually decreases in the direction in which the first protrusion 11 is inserted. The rear holder 700 may further include an upper rib 741 and a lower rib 742, and the insertion portion 740 may be formed between the upper rib 741 and the lower rib 742.

The first protrusion 11 is interference-fitted into the insertion portion 740. The insertion portion 740 may be provided with a locking portion 744 for preventing the first protrusion 11 from being separated from the insertion portion 740.

The lower rib 742 has therein a latching recess 743. The distal end of the second rail contacts the latching recess 743, whereby the rear holder 700 is prevented from being moved further forwards along the second rail. In particular, when the basket 10 is pulled, the latching recess 743 may prevent the rear holder 700 from being moved forwards.

An additional insertion portion, which has the same configuration as the aforementioned insertion portion 740, may be formed. At this time, it is desirable for the two insertion portions to be vertically symmetrical to each other.

The reason for this is to use the rear holder 700 in common for both the left drawer rail and the right drawer rail.

Figure 12:
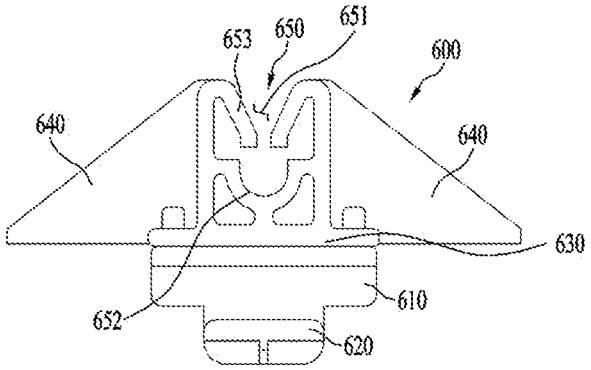
FIG. 12 illustrates the appearance of a front holder of the drawer rail.

Hereinafter, the configuration of the front holder 600 will be described in detail with reference to FIG. 12.

The front holder 600 includes a vertical surface 610 and a bent surface 630, which is formed at the upper end of the vertical surface. The vertical surface 610 is configured to contact the vertical surface of the second rail 300, and the bent surface 630 is configured to cover the upper bent surface of the second rail 300. Because the front holder 600 is coupled to the middle portion of the second rail 300, the front holder 600 needs to be prevented from being moved forwards and backwards along the second rail 300. To this end, the vertical surface 610 may be provided with a protrusion 620. The protrusion 620 is inserted into the front-holder-perforated portion 215 formed in the second rail 300.

The front holder 600 includes an insertion portion 650, into which the second protrusion 12 is inserted. The insertion portion 650 may be formed such that a lateral width thereof gradually decreases in the direction in which the second protrusion 12 is inserted (in the downward direction). The front holder 600 may further include left and right ribs 653, and the insertion portion 650 may be formed between the left and right ribs 653.

The insertion portion 650 is provided at the lower portion thereof with a seating portion 652, in which the second protrusion 12 is seated. When the second protrusion 12 is inserted into the insertion portion 650, the left and right ribs may be elastically deformed so as to increase the lateral width thereof. When the second protrusion 12 is inserted into and seated in the seating portion 652, the left and right ribs may be elastically restored. Therefore, even when the second protrusion 12 moves upwards, the second protrusion 12 is caught by the left and right ribs and is prevented from being separated therefrom. When it is intended to forcibly separate the second protrusion 12 from the insertion portion 650, the distance between the left and right ribs may be increased using a separate tool.

The front holder 600 may further include reinforcement ribs 640, which are formed at the left side and the right side of the insertion portion 650 in order to reinforce the rigidity of the insertion portion 650.

It is desirable for the reinforcement ribs 640 to be horizontally symmetrical to each other. The reason for this is to use the front holder 600 in common for both the left drawer rail and the right drawer rail.

The front holder 600 and the rear holder 700 are formed through plastic injection molding. Therefore, the front holder 600 and the rear holder 700 have their own specific elastic properties. Therefore, the front holder 600 and the rear holder 700 may be securely fixed to the second rail due to their specific configurations and the perforated portions and the configuration of the second rail, which mesh with the configurations of the holders, without a separate fastening tool.

Hereinafter, the configuration for mounting the drawer rail 100 to the tub will be described with reference to FIGS. 13 and 14.

Figure 13:
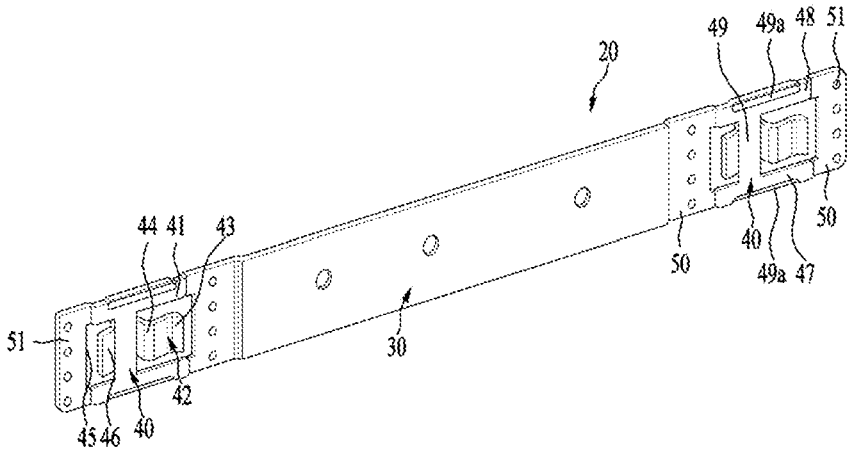
FIG. 13 illustrates the appearance of a rail bracket for mounting the drawer rail.

FIG. 13 illustrates a rail bracket 20 for mounting the drawer rail 100 to the tub. The rail bracket 20 is fixed to the side surface of the tub, and the drawer rail 100 is coupled to the rail bracket 20. Specifically, as shown in FIG. 14, the drawer rail 100 is coupled to the rail bracket 20 by the coupling of the first rail 200 to the rail bracket 20.

The rail bracket 20 may be fixed to the side surface of the tub in various ways. However, it is desirable to fix the rail bracket 20 to the side surface of the tub through welding in order to realize a reliable assembly. To this end, the rail bracket 20 may be provided with welded portions 51.

The rail bracket 20 includes a body 30. The body 30 may include a contact portion 50, which is configured to closely contact the side wall of the storage chamber, and a raised portion 40, which protrudes relative to the contact portion 50 so as to be spaced apart from the side wall of the storage chamber. The contact portion 50 may be formed at each of the front side and the rear side of the raised portion 40. The welded portions 51 may be formed at the contact portion 50.

The rail bracket 20 may include openings, which are formed in the front portion and the rear portion of the body, and bracket hooks 42, each of which is provided at a respective one of the openings.

The bracket hook 42 may include a latching portion 44, which is provided at the front end of the opening in order to limit the forward movement of the drawer rail, and a cover portion 43, which extends backwards from the latching portion 44 in order to limit the lateral movement of the drawer rail. The cover portion 43 is bent from the latching portion 44, and thus the cover portion 43 may be elastically deformed.

The bracket hook 42 may be formed through a hook-perforated portion 41. That is, the bracket hook 42 may be formed in a manner such that a portion of the raised portion 40 is bent through the hook-perforated portion 41. Therefore, it is desirable for the bracket hook 42 to be formed at the raised portion 40.

The raised portion 40 may include a stopper 46, which is provided in front of the bracket hook 42 in order to limit the backward movement of the drawer rail. The raised portion 40 may have therein a stopper-perforated portion 45 in order to form the stopper. The stopper may be formed by bending a portion of the raised portion.

The raised portion 40 may include an upper portion 48 and a lower portion 47. The raised portion 40 may further include a connection portion 49 for connecting the upper portion 48 and the lower portion 47 to each other in the vertical direction. The hook-perforated portion 41 and the stopper-perforated portion 45 may be spaced laterally apart from each other, with the connection portion 49 interposed therebetween.

A load may be applied to the bracket hook 42 in the downward direction via the drawer rail 100. Thus, there may occur a problem in which the upper portion 48 and the lower portion 47 are deformed. In order to solve this problem, the upper portion 48 and the lower portion 47 may be provided with beads 49*a*. The beads may extend in the forward-and-backward direction and may be formed so as to be concave or convex in the lateral direction. These beads serve to increase the torsion resistance of the rail bracket 20.

The rail bracket 20 may be formed to be vertically and horizontally symmetrical. Therefore, it is possible to use the rail bracket 20 in common for both the left drawer rail and the right drawer rail.

Figure 14:
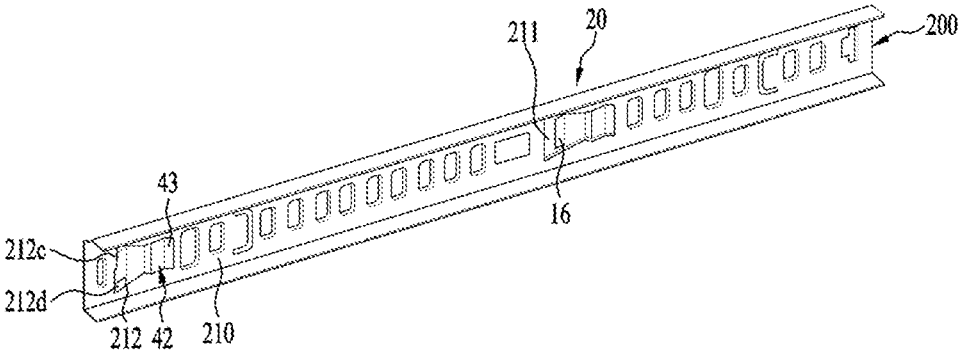
FIG. 14 illustrates the state in which the rail bracket and the first rail of the drawer rail are engaged with each other.

FIG. 14 illustrates the state in which the first rail 200, among the components of the drawer rail 100, is engaged with the rail bracket 20.

The first rail 200 has therein the hook-perforated portions 211 and 212, into which the bracket hooks 42 are inserted. The size of the hook-perforated portions is larger than that of the bracket hooks 42 so that the bracket hooks 42 are easily inserted into the hook-perforated portions.

If the first rail 200 is pulled after the bracket hooks 42 are inserted into the hook-perforated portions, the cover portion 43 covers the vertical surface 210 of the first rail. At this time, the latching portion 44 is caught by ends 211*d*, 212*d* of the hook-perforated portions. Therefore, the first rail is prevented from being pulled further.

When the first rail is moved backwards, the opposite ends 211*c* and 212*c* of the hook-perforated portions are caught by the stoppers 46. Therefore, the first rail is prevented from being separated from the rail bracket.

After the first rail is completely engaged with the rail bracket, a certain degree of relative movement therebetween may be allowed. That is, a certain degree of movement of the opposite ends of the hook-perforated portions and the stoppers 46 relative to each other may be allowed. The reason for this is to make it possible to separate the first rail and the rail bracket from each other as needed. However, this allowance of relative movement may result in noise due to collision between the opposite ends of the hook-perforated portions and the stoppers when the basket is withdrawn.

In order to solve this problem, configuration may be made such that the relative movement between the opposite end of any one of the hook-perforated portions and the corresponding stopper is allowed and such that the opposite end of the other one of the hook-perforated portions and the corresponding stopper are maintained in contact with each other. The contact between the opposite end of the hook-perforated portion and the stopper prevents movement of the first rail, and consequently reduces the occurrence of noise. Therefore, any one of the hook-perforated portions is formed to be larger than the other one of the hook-perforated portions.

In order to release the contact between the stopper and the opposite end of the hook-perforated portion, the first rail needs to be moved in the direction away from the side wall of the storage chamber. This movement is realized by a user who applies force for separating the components. Therefore, for user's convenience, this moving operation is performed in front of the first rail. Out of the hook-perforated portions, the front hook-perforated portion may be provided at the opposite end thereof with a stepped portion 212*e* in order to receive the user's force. Due to the stepped portion, a portion of the hook-perforated portion is in contact with the stopper, and a remaining portion of the hook-perforated portion is spaced apart from the stopper. The first rail may be moved laterally by inserting a tool into the space between the hook-perforated portion and the stopper. In this state, if the first rail is moved backwards, the bracket hook may be separated from the rear hook-perforated portion.

In order to be separated from the stopper, the rear hook-perforated portion needs to be moved laterally. Therefore, in order to ensure this movement distance, it is desirable for the opposite end of the rear hook-perforated portion to be provided so as to be spaced apart from the stopper.

In conclusion, it is desirable for the rear hook-perforated portion to have a larger size than the front hook-perforated portion.

Each of the hook-perforated portions includes a front inclined portion 212*a* and a rear horizontal portion 212*b*. The inclined portion may be formed such that the vertical width thereof gradually decreases toward the rear end thereof, and the horizontal portion may be formed such that the vertical width thereof is constant. Therefore, the bracket hook easily slides along the inclined portion of the hook-perforated portion and subsequently moves to the horizontal portion.

As is apparent from the above description, the present invention provides a drawer rail, which has improved reliability by preventing the separation of sub-rails constituting the drawer rail, and a home appliance including the same.

In addition, the present invention provides a drawer rail, which is capable of being easily engaged with or disengaged from an item accommodation unit, and a home appliance including the same.

In addition, the present invention provides a drawer rail, which is capable of being easily engaged with or disengaged from a home appliance, and a home appliance including the same.

In addition, the present invention provides a drawer rail, which is capable of being more securely fixed to a home appliance, and a home appliance including the same.

In addition, the present invention provides a drawer rail, which is capable of preventing noise from occurring between the drawer rail and a home appliance, and a home appliance including the same. In particular, the present invention provides a drawer rail and a home appliance that is capable of preventing noise from occurring between a bracket mounted to the home appliance and the drawer rail.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A home appliance defining a storage chamber configured to receive an item accommodation unit, the home appliance comprising:

a drawer rail configured to withdraw the item accommodation unit from the storage chamber, the drawer rail comprising:

a first rail configured to couple to the storage chamber, a second rail configured to couple to the item accommodation unit, a third rail located between the first rail and the second rail, a first retainer located between the first rail and the third rail, and configured to allow the first rail to move relative to the third rail, a second retainer located between the second rail and the third rail, and configured to allow the second rail to move relative to the third rail, a first stopper that is configured to limit a first distance between the first rail and the third rail, the first stopper comprising a stopper flange being disposed on the first rail at a position further inward than a distal end of the first rail and a stopper protrusion being disposed on the first retainer at a position further inward than a distal end of the first retainer, and a second stopper that is configured to limit a second distance between the second rail and the third rail, the second stopper comprising a stopper flange being disposed on the second rail at a position further inward than a distal end of the second rail and a stopper protrusion being disposed on the second retainer at a position further inward than a distal end of the second retainer, wherein the first rail and the second rail each comprises a plurality of perforated portions, wherein the perforated portions comprise bending-perforated portions that include a bending portion configured to be bent to define the stopper flange of the first stopper and the stopper flange of the second stopper based on a bending process, and the stopper flange of the first stopper and the stopper flange of the second stopper are defined by the bending process through the bending-perforated portions, and wherein the bending-perforated portions are located at positions further inward than outermost perforated portions.

2. The home appliance according to claim 1, wherein each of the first rail and the second rail comprises a vertical surface, and bent surfaces that are bent from an upper end and a lower end of the vertical surface toward an inside of the storage chamber.

3. The home appliance according to claim 2, wherein the vertical surface defines the plurality of perforated portions, wherein the first rail and the second rail have a same size and a same shape, and wherein the plurality of perforated portions of the first rail are configured to correspond to the plurality of perforated portions of the second rail.

4. The home appliance according to claim 3, wherein the bending-perforated portions of each of the first rail and the second rail comprises:

a front pair of bending-perforated portions located at a front portion of each of the first rail and the second rail; and a rear pair of bending-perforated portions located at a rear portion of each of the first rail and the second rail.

5. The home appliance according to claim 4, wherein the stopper flange of each of the first stopper and the second stopper comprises:

a front stopper flange located at one of the front pair of bending-perforated portions; and a rear stopper flange located at one of the rear pair of bending-perforated portions.

6. The home appliance according to claim 5, wherein the front stopper flange of the first stopper is positioned offset from the front stopper flange of the second stopper, and wherein the rear stopper flange of the first stopper is positioned offset from the rear stopper flange of the second stopper.

7. The home appliance according to claim 1, wherein each of the first retainer and the second retainer comprises:

an upper ball accommodation portion located at an upper end of each of the first retainer and the second retainer;

a lower ball accommodation portion located at a lower end of each of the first retainer and the second retainer; and a plurality of connecting portions that connect the upper ball accommodation portion to the lower ball accommodation portion, wherein the upper and lower ball accommodation portions are configured to accommodate balls.

8. The home appliance according to claim 7, wherein the plurality of connecting portions comprise:

end-connecting ribs located at a first end and a second end of each of the first retainer and the second retainer; and middle-connecting ribs located between the end-connecting ribs.

9. The home appliance according to claim 8, wherein the stopper protrusion of the first stopper is located at the middle-connecting ribs of the first retainer, and wherein the stopper protrusion of the second stopper is located at the middle-connecting ribs of the second retainer.

10. The home appliance according to claim 1, wherein each of the stopper protrusion of the first stopper and the stopper protrusion of the second stopper is configured to contact to the stopper flange of each of the first stopper and the second stopper in a direction in which the stopper flange is bent.

11. The home appliance according to claim 1, wherein the plurality of perforated portions of each of the first and second rails comprise:

a bracket-perforated portion configured to couple the drawer rail to the storage chamber; and a front-holder-perforated portion and a rear-holder-perforated portion that are configured to couple the item accommodation unit to the drawer rail.

12. The home appliance according to claim 11, wherein the drawer rail further comprises:

a front holder configured to couple to the front-holder-perforated portion of the second rail, the front holder comprising an insertion portion that extends from an upper end thereof in a downward direction; and a rear holder configured to couple to the rear-holder-perforated portion of the second rail, the rear holder comprising an insertion portion that extends from a rear end of thereof in a forward direction of the one of the first rail or the second rail.

13. The home appliance according to claim 1, wherein the drawer rail further comprises retainer stoppers located at the third rail and configured to limit movement ranges of the first retainer and the second retainer relative to the third rail.

14. The home appliance according to claim 13, wherein the third rail has a symmetric shape with respect to a vertical axis, and is configured to accommodate the first retainer at a first side of the vertical axis and the second retainer at a second side of the vertical axis.

15. The home appliance according to claim 14, wherein the retainer stoppers comprise a front retainer stopper configured to contact a first end of the first retainer, and a rear retainer stopper configured to contact a second end of the first retainer opposite of the first end of the first retainer.

16. The home appliance according to claim 14, wherein the retainer stoppers comprise a front retainer stopper configured to contact a first end of the second retainer, and a rear retainer stopper configured to contact a second end of the second retainer opposite of the first end of the second retainer.

17. The home appliance according to claim 13, wherein the retainer stoppers are configured to contact an upper end or a lower end of at least one of the first retainer or the second retainer, and wherein each of the stopper flange of the first stopper and the stopper flange of the second stopper is positioned at a middle portion between the upper end and the lower end and is configured to avoid interference with the retainer stoppers.

* * * * *